US007182287B2

(12) United States Patent
Denker et al.

(10) Patent No.: US 7,182,287 B2
(45) Date of Patent: Feb. 27, 2007

(54) GRIPPER FOR RESIDUAL WINDINGS WHICH MAY BE WOUND FROM RESIDUAL STRIP RUNNING FROM STRIP PLANTS AT THE ROLL END

(75) Inventors: Wolfgang Denker, Freudenberg (DE); Michael Schäfer, Siegen (DE)

(73) Assignee: SMS Demag AG, Düsseldorf (DE)

( * ) Notice: Subject to any disclaimer, the term of this patent is extended or adjusted under 35 U.S.C. 154(b) by 107 days.

(21) Appl. No.: 10/494,216

(22) PCT Filed: Nov. 9, 2002

(86) PCT No.: PCT/EP02/12541

§ 371 (c)(1),
(2), (4) Date: Apr. 28, 2004

(87) PCT Pub. No.: WO03/045602

PCT Pub. Date: Jun. 5, 2003

(65) Prior Publication Data

US 2004/0251373 A1 Dec. 16, 2004

(30) Foreign Application Priority Data

Nov. 29, 2001 (DE) ..... 101 58 591

(51) Int. Cl.
*B65H 19/22* (2006.01)

(52) U.S. Cl. ..... 242/533.3; 242/539; 242/541; 242/548

(58) Field of Classification Search ..... 242/533.3, 242/539, 541, 533, 542, 542.2, 548, 547
See application file for complete search history.

(56) References Cited

U.S. PATENT DOCUMENTS

| | | | | | |
|---|---|---|---|---|---|
| 1,966,331 | A | * | 7/1934 | Cameron | 242/542 |
| 1,987,141 | A | * | 1/1935 | Casper | 242/547 |
| 2,526,010 | A | | 10/1950 | Edstrom | |
| 3,010,668 | A | * | 11/1961 | McPherson et al. | 242/533 |
| 3,062,465 | A | | 11/1962 | Hunter | |
| 3,998,399 | A | * | 12/1976 | Held et al. | 242/542 |
| 4,706,586 | A | * | 11/1987 | Vogt et al. | 242/547 |
| 5,584,443 | A | * | 12/1996 | Butterworth | 242/542 |

FOREIGN PATENT DOCUMENTS

| | | | | |
|---|---|---|---|---|
| DE | 3404893 | | 8/1985 | |
| DE | 8711281 | | 1/1988 | |
| JP | 61-217452 | * | 9/1986 | 242/533 |

* cited by examiner

*Primary Examiner*—William A. Rivera
(74) *Attorney, Agent, or Firm*—Friedrich Kueffner

(57) ABSTRACT

The invention relates to a gripper for residual windings (1), which may be wound from residual strip (2), running from strip plants at the roll end, where said gripper can be pivoted or displaced about a strip plant and which can be embodied for a more rational operation mode, whereby the gripper (3), in addition to the function there of as drawing device (3*a*), is embodied as winding device (3*b*).

10 Claims, 1 Drawing Sheet

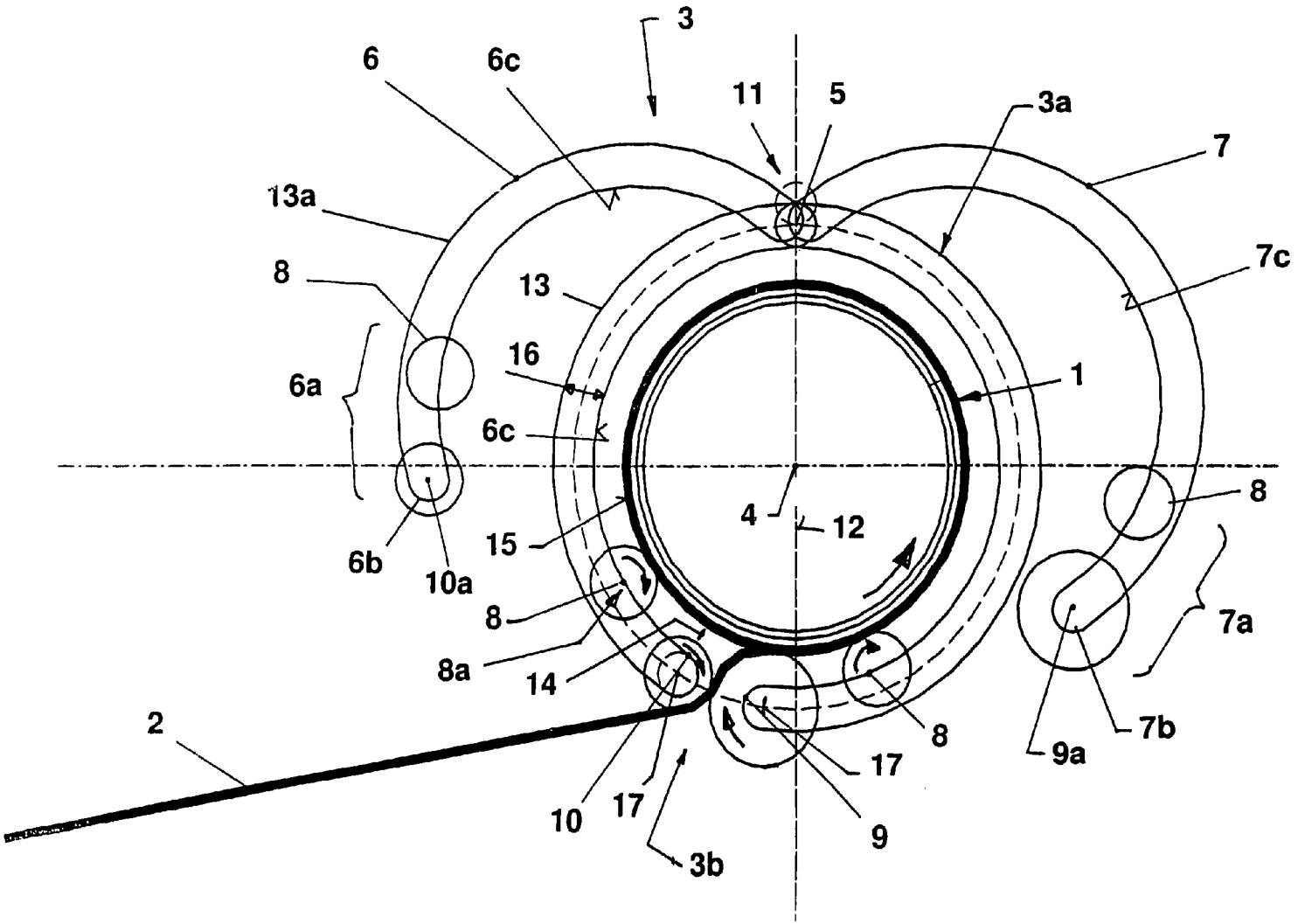
7c
7
8
7a
7b
9a
3a
1
8
17
9
5
12
11
4
3
3b
17
10
6c
13
16
6c
15
8
14
8a
10a
6
6b
13a
8
6a
2

GRIPPER FOR RESIDUAL WINDINGS WHICH MAY BE WOUND FROM RESIDUAL STRIP RUNNING FROM STRIP PLANTS AT THE ROLL END

The invention concerns a gripper for residual coils which may be wound from residual strip running from strip mills at the end of a rolling operation, such that the gripper is installed in such a way that it can be pivoted or moved above a strip mill.

In temper rolling mills, especially in the case of thin strip or tin strip rolling, residual coils are taken over from an unwinding coiler mandrel by a discharging device and fed to a scrap utilization station.

The gripper used for this purpose is already known as a discharging device (DE 87 11 281.7 U1). The gripper can be arranged to pivot or move above the mill. Its end positions are the unwinding coiler mandrel and the scrap container or a residual coil station. The residual strip is wound into the residual coil in an unwinding coiler, after which the gripper grips the residual coil, the coiler mandrel is then unspread and moved out of the residual coil, and then the residual coil is lifted and sent for further utilization. These operations take a certain amount of time, which determines the course and the economy of the process. So far it has not been possible to reduce this time. Since any savings of time affect the economy of the plant as a whole, the time factor is quite important.

The objective of the invention is to achieve a more economical operation through the design of the gripper.

In accordance with the invention, this objective is achieved by designing the gripper to function not only as a discharging device, but also as a coiling device. This makes it possible to eliminate a step that has previously been necessary, namely, the separate coiling of the residual strip into a residual coil on a coiler mandrel, with the result that considerable time savings are realized. Therefore, the plant as a whole operates more economically. 20 seconds can thus be saved for each coil, which means that at 5 coils/h in a three-shift operation, about 140 h/year can be saved. Looked at in another way, the invention makes it possible to achieve an additional 140 hours of production time per year.

The invention can be realized in the form of various designs. In one advantageous embodiment, a pair of gripping arms is supported in such a way that the arms can be swung in opposite directions about an axis of rotation that runs parallel to the axis of the coiler mandrel, a supporting roller is rotatably supported on the inner aspect of the end regions of each of the gripping arms, a driven roller is rotatably supported on the end of one of the gripping arms, and a mating roller is rotatably supported on the opposing end of the other gripping arm. This allows the gripper to function not only as a discharging device, but also as a coiling device. Therefore, the coiling of the residual strip no longer occurs on the coiler mandrel, but rather directly in the gripper. This displacement of the coiling operation into the gripper is responsible for the time savings mentioned above. For example, this allows an unwinding coiler with a double expansion head to be opened earlier, the residual coil to be lifted earlier (even if it still going to be rewound), and thus the next coil to be supplied to the plant earlier. The coil succession time can be significantly shortened in this way, and this results in more economical utilization of the plant as a whole. In addition, this ensures that the residual coil can be wound and at the same time the coiler mandrel can be unspread and moved vertically. The driven roller conveys the residual strip into the pincer-like supporting device and at the same time drives the residual coil. Immediately after the coiler mandrels have been moved out of the residual coil, the gripper with the residual coil is lifted, and the next coil can be moved onto the center of the coiler mandrel.

For the clamping operation of the gripper, it is sufficient that the supporting rollers are rotatably supported in such a way that they can idle.

Another embodiment provides that the mating roller is designed with a smaller diameter than the associated driven roller. In this way, the driving power is applied for conveying, guiding, and bending the residual strip, and the mating roller takes on only bending work.

The desired configuration for the mating roller and the driven roller is supported by the fact that the swivel hinge for the swiveling gripping arms in the operating position forms a plane with the coiler mandrel axis.

This configuration is further supported by the fact that the driven roller is arranged at an angle of 5°° to 10°° in front of the plane in which the coiler mandrel axis and the axis of rotation of the pair of gripping arms run in the operating position.

The configuration is further utilized by arranging the axis of rotation of the mating roller relative to the driven roller at a distance from the instantaneous circumference of the residual strip to be coiled. The advantage here is that the growth of the residual coil can be automatically taken into account by the outward displacement of the gripping arms.

To adjust and maintain this distance, it is further provided that the axis of rotation of each supporting roller is pivoted approximately on the inner circumference of the respective gripping arm.

On the other hand, it is further provided that the mating roller and the driven roller are pivoted with their axes of rotation approximately in the middle of the thickness of the respective gripping arm.

This design is further supplemented by pivoting the mating roller and the driven roller with their axes of rotation at the end of the respective gripping arm in an end-center point.

The drawing shows an embodiment of the invention, which is explained in detail below.

The sole drawing shows a side view of the gripper with the residual coil.

The residual coil 1 is to be coiled from a residual strip 2. A gripper 3 is used for this purpose to coil the residual coil 1 at the end of a rolling operation from residual strip 2 running out of a strip mill, such that the gripper can be pivoted or moved above a strip mill.

The gripper 3 is shown both in its operating position 13 and in its nonoperating position 13*a* with its gripping arms 6, 7 swung out.

Besides acting as a discharging device 3*a*, the gripper 3 additionally acts as a coiling device 3*b*. The gripper 3 has gripping arms 6 and 7 that can swing in opposite directions about an axis of rotation 5 that runs parallel to the axis 4 of the coiler mandrel. A supporting roller 8 is rotatably supported on the inner aspect of the end regions 6*a* and 7*a* of each of the gripping arms 6 and 7. A driven roller 9 is rotatably supported on the end 7*b* of one of the gripping arms, and a mating roller 10 is rotatably supported on the opposing end 6*b* of the other gripping arm. The supporting rollers 8 are rotatably supported idler rollers and retain the residual coil horizontally and vertically.

The mating roller 10 has a smaller diameter than the associated driven roller 9. The supporting rollers 8, the driven roller 9 and the mating roller 10 are arranged in such a way that a swivel hinge 11 for the swiveling gripping arms in the operating position forms a plane 12 with the coiler mandrel axis 4. The driven roller 9 is arranged at an angle of 5°° to 10°° in front of the plane 12 formed by the coiler mandrel axis 4 and the axis of rotation 5 of the pair of gripping arms 6, 7 in operating position 13.

The necessary freedom of the residual strip 2 for the growing thickness of the residual coil 1 is obtained by arranging the axis of rotation 10*a* of the mating roller 10 relative to the driven roller 9 at a distance 14 from the instantaneous circumference 15 of the residual strip 2 to be coiled. The distance 14 is further maintained by virtue of the fact that the axis of rotation 8*a* of each supporting roller 8 is pivoted approximately on the inner circumference 6*c*, 7*c* of the respective gripping arm 6 and 7.

The mating roller 10 and the driven roller 9, respectively, are pivoted with their axes of rotation 10*a* and 9*a* approximately in the middle of the thickness 16 of the respective gripping arm.

The configuration is further supplemented by pivoting the mating roller 10 and the driven roller 9 with their axes of rotation 10*a*, 9*a* at the end 6*b*, 7*b* of the respective gripping arm 6 or 7 in an end-center point 17.

LIST OF REFERENCE NUMBERS

1 residual coil
2 residual strip
3 gripper
3*a* discharging device
3*b* coiling device
4 coiler mandrel axis
5 axis of rotation
6 gripping arm
6*a* end region of the gripping arm
6*b* end of gripping arm
6*c* inner circumference of the gripping arm
7 gripping arm
7*a* end region of the gripping arm
7*b* end of gripping arm
7*c* inner circumference of the gripping arm
8 supporting roller
8*a* axis of rotation of the supporting roller
9 driven roller
9*a* axis of rotation of the driven roller
10 mating roller
10*a* axis of rotation of the mating roller
11 swivel hinge
12 plane of the coiler mandrel axis
13 operating position
13*a* nonoperating position
14 distance
15 instantaneous circumference
16 thickness of the gripping arm
17 end-center point

The invention claimed is:

1. Gripper for residual coils which may be wound from residual strip running from strip mills at the end of a rolling operation, such that the gripper is installed in such a way that it can be pivoted or moved above a strip mill, wherein besides acting as a discharging device (3*a*), the gripper (3) additionally acts as a coiling device (3*b*), wherein the gripper (3) has a driven roller (9).

2. Gripper in accordance with claim 1, wherein a pair of swiveling gripping arms (6; 7) are supported in such a way that the arms can be swung in opposite directions about an axis of rotation (5) that runs parallel to the axis (4) of a coiler mandrel, a supporting roller (8) is rotatably supported on the inner aspect of end regions (6*a*; 7*a*) of each of the gripping arms, wherein the driven roller (9) is rotatably supported on the end (7*b*) of one of the gripping arms, and a mating roller (10) is rotatably supported on the opposing end (6*b*) of the other gripping arm.

3. Gripper in accordance with claim 2, wherein the supporting rollers (8) are rotatably supported idler rollers.

4. Gripper in accordance with claim 2, wherein the mating roller (10) is designed with a smaller diameter than the associated driven roller (9).

5. Gripper in accordance with claim 2, wherein a swivel hinge (11) for the swiveling gripping arms (6; 7) in the operating position forms a plane (12) with the coiler mandrel axis (4).

6. Gripper in accordance with claim 2, wherein the driven roller (9) is arranged at an angle of 5° to 10° in front of the plane (12) in which the coiler mandrel axis (4) and the axis of rotation (5) of the pair of gripping arms (6; 7) run in the operating position.

7. Gripper in accordance with claim 2, wherein the axis of rotation (10*a*) of the mating roller (10) is arranged relative to the driven roller (9) at a distance (14) from an instantaneous circumference (15) of the residual strip (2) to be coiled.

8. Gripper in accordance with claim 2, wherein the axis of rotation (8*a*) of each supporting roller (8) is rotatable approximately on an inner circumference (6*c*; 7*c*) of the respective gripping arm (6; 7).

9. Gripper in accordance with claim 2, wherein the mating roller (10) and the driven roller (9) are rotatable with their axes of rotation (10*a*; 9*a*) approximately in a middle of a thickness (16) of the respective gripping arm.

10. Gripper in accordance with claim 2, wherein the mating roller (10) and the driven roller (9) are rotatable with their axes of rotation (10*a*; 9*a*) at the end (6*b*; 7*b*) of the respective gripping arm (6; 7) in an end-center point (17).

* * * * *